United States Patent [19]

Johnson et al.

[11] Patent Number: 4,979,354

[45] Date of Patent: Dec. 25, 1990

[54] DEVICE FOR FACILITATING DRIVING OF A THREADED SCREW

[76] Inventors: Kevin M. Johnson, 72 Vassar St., Rochester, N.Y. 14607; Chris L. Colby, 367 Whittier Rd., Spencerport, N.Y. 14559

[21] Appl. No.: 361,422

[22] Filed: Jun. 5, 1989

[51] Int. Cl.[5] ..... B25B 23/08

[52] U.S. Cl. ..... 81/451

[58] Field of Search ..... 81/451–458

[56] References Cited

U.S. PATENT DOCUMENTS 768,441 8/1904 Fisher ..... 81/451

1,939,268 12/1933 Kroll ..... 81/458

FOREIGN PATENT DOCUMENTS 1221763 6/1960 France ..... 81/456

*Primary Examiner*—D. S. Meislin

*Attorney, Agent, or Firm*—Lawrence P. Kessler

[57] ABSTRACT

A device for facilitating driving of a threaded screw into a member by a screw driver having a shank and a drive head. Such device comprises an elongated housing having first and second longitudinally aligned portions, the first portion configured to readily removably receive the shank of the screw driver with a friction fit restraining the shank to limited relative movement with respect to the first portion along the longitudinal axis of the shank, and defining an enlarged longitudinal slot through which the drive head and shank of the screw driver are insertable at an angle to the longitudinal axis of the first portion. A second portion is configured to have one end engageable with such member and receive a threaded screw and drive head in driving relation therein.

3 Claims, 1 Drawing Sheet

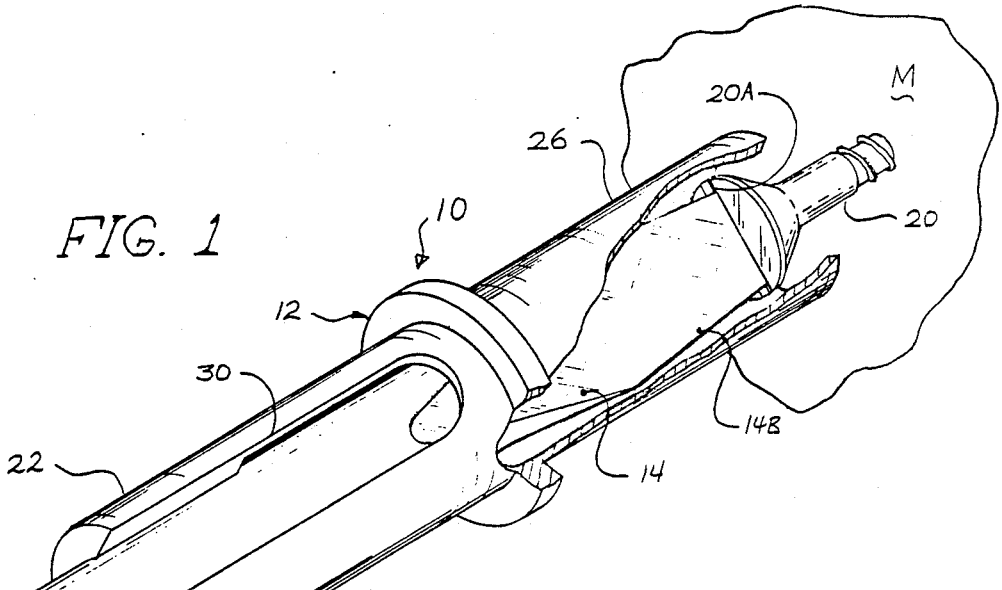
FIG. 1
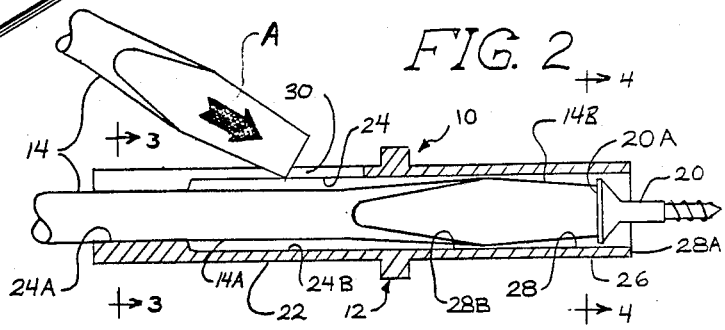
FIG. 2
FIG. 3
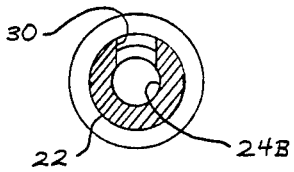
FIG. 4
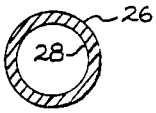
FIG 5.
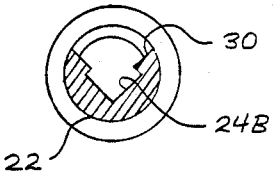
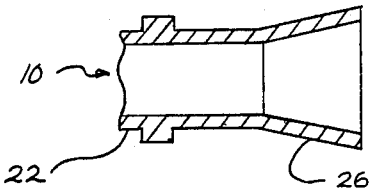
FIG. 6

DEVICE FOR FACILITATING DRIVING OF A THREADED SCREW

BACKGROUND OF THE INVENTION

This invention relates in general to facilitating driving of threaded screws, and more particularly to a device which enables a screw driver to be accurately associated with a threaded screw during driving of the screw without slippage.

Threaded screws are one of the most common forms of hardware used to fasten members together. Typically, a threaded screw has a slotted head which is engaged by a blade-like drive head of a screw driver. Rotation of the screw driver, either manually or by a power source, rotates the screw which then self feeds into the members to be joined, or into a complimentary threaded member. Universal problems associated with the driving of threaded screws are intitial alignment of the drive head with the screw slot and the slippage of the head from the slot during the driving action. In each instance, slippage of the blade-like drive head from the screw can cause damage to the surface (e.g., wood or aluminum) of the members being joined, or injury to the person using the screw driver.

In order to reduce the potential of slippage of the screw driver drive head from the screw, a class of screws referred to as Phillips head screws have been developed. The Phillips head screw has a cross-like slot engageable by a complimentary shaped drive head. While the occurance of slippage of the drive head from the slot in the screw is less likely than with the blade-like configuration, it has only been somewhat reduced. This is in part due to the fact that relatively more force is required at drive contact; therefore, relative rotational forces can still cause the drive head to slip out of the cross-like slot. Additionally, this slippage problem has been addressed by mechanical devices which clamp on to the screw driver and hold the the threaded screw relative to the driver head. Examples of such device are shown in U.S. Pats. No. 768,441 (issued Aug. 23, 1904 in the name of Fisher) and 2,723,694 (issued Nov. 15, 1955 in the name of Ross). However such devices are limited as to the geometry of the screw driver head that they can accomodate. Moreover, the manner in which they seat on the screw driver shaft allows for relative transverse movement of the devices relative to the associated screw driver heads. This results in difficulty in aligning the head with the screw.

SUMMARY OF THE INVENTION

This invention is directed to a device for facilitating driving of a threaded screw into a member by a screw driver having a shank and a drive head. Such device comprises an elongated housing having first and second longitudinally aligned portions, the first portion configured to readily removably received the shank of the screw driver with a friction fit restraining the shank to limited relative movement with respect to the first portion along the longitudinal axis of the shank, and defining an enlarged longitudinal slot through which the drive head and shank of the screw driver are insertable at an angle to the longitudinal axis at the first portion. A second portion is configurated to have one end engageable with such member and receive a threaded screw and drive head in driving relation therein.

The invention, and its objects and advantages, will become more apparent in the detailed description of the preferred embodiment presented below.

BRIEF DESCRIPTION OF THE DRAWINGS

In the detailed description of the preferred emobodiment of the invention presented below, reference is made to the accompanying drawings, in which:

FIG. 1 is a view, in perspective, of the device for facilitating the driving of threaded screws according to this invention;

FIG. 2 is a side elevational view, in cross-section, of the device for facilitating the driving of threaded screws of FIG. 1;

FIG. 3 is an end elevational view, in cross-section, of the device of FIG. 1 taken along lines 3—3 thereof;

FIG. 4 is an end elevational view, in cross-section, of the device of FIG. 1 taken along lines 4—4 thereof;

FIG. 5 is an end elevational view similar to FIG. 3, in cross-section, of an alternate configuration for the device according to this invention; and FIG. 6 is a side elevational view similar to FIG. 2, showing another alternate configuration for the device according to this invention;

DESCRIPTION OF THE PREFERRED EMBODIMENTS

Referring now to the accompanying drawings, FIGS. 1–4 show the device according to this invention for facilitating the driving of a threaded screw, such device being designated by the numeral 10. The device 10 is a simple, one piece arrangement 12 which is selectively mountable on the shank 14*a* of a screw driver 14 so as to align the drive head 14*b* of the screw driver with the slotted head 20*a* (or Phillips head slots) of a threaded screw 20. The assembly 12 is configurated as a substantially tubular housing having a first portion 22 defining a chamber 24, and a spaced second portion 26 defining a chamber 28. The tubular housing is formed from a material, such as plastic or sheet metal for example, and is fabricated by injection molding, casting or machining depending on the material.

The first portion 22 of the assembly 12 is adapted to receive the drive head 14*b* of the screw driver 14, and thereafter be slidably retained on the shank 14*a* thereof. Accordingly, the portion 22 defines a substantially 4-shaped longitudinal slot 30 communicating with the chamber 24 and being of a width sufficient to freely accept the drive head 14*b* and shank 14*a* of the screw driver 14. The chamber 24 has two intercommunicating cavities 24*a* and 24*b*. The cavity 24*a* is of a cross-sectional dimension complimentary to, and fractionally smaller than, the cross-sectional dimension of the shank of the screw driver. In this manner, after the drive head and shank are inserted at an angle in the direction of arrow A into the cavity 24*b* through slot 30, the shank may be force fitted into the cavity 24*a* (see FIG. 2) with a portion of said cavity 24B serving a fulcrum-like function enabling pivoting of the shank into the cavity 24A in alignment with the longitudinal axis thereof. Since there is a wide variety of screw driver head geometries but a high degree of commonality between screw driver shanks, only a limited number of sizes for the assembly 12 have to be provided. Due to the fact that the elastic range of the material forming the assembly 12 is not exceeded, the assembly is retained on the shank 14*a*, yet is movable relative to the shank only in a longitudinal direction. Of course, the configuration of the cross-sectional dimension of the screw driver shank 14*a*, and thus the complimentary cross-sectional dimension of the cavity 24*a* may be of any suitable design (e.g., round as shown in FIG. 3, or hexagonal or square as shown in FIG. 5).

The chamber 28 of the second portion 26 of the assembly 12 is adapted to receive the slotted head 20*a* of the threaded screw 20 through an opening in one and 28*a* thereof. The opposite end 28*b* of the chamber 28 communicates with the cavity 24*b* of the chamber 24. Accordingly, the drive head 14*b* of the screw driver 14 located in the chamber 24 is substantially aligned with a threaded screw 20 located in the chamber 28. While the portion 26 is shown in FIG. 4 as being substantially cylindrical in configuration so as to substantially capture the threaded screw, it could of course have other configurations, such as flared as shown in FIG. 6 so as to more readily seat on a member into which the screw is to be driven.

In operation, the screw driver 14 is inserted into the assembly 12 in the manner described above with particular reference to FIG. 2. After the threaded screw 20 is located relative to a member M into which it is to be driven, the assembly 12 is brought into juxtaposition with the slotted head 20*a* of the screw, the slotted head being received through the opening in the end 28*a* of the portion 26. The assembly 12 is moved relative to the shank 14*a* of the screw driver until the slotted head 20*a* is fully received within the chamber 28. The drive head 14*b* is thus substantially aligned with the slotted head 20*a* of the screw for driving engagement therewith. It can be readily appreciated that since the assembly 12 is only slightly larger in cross-section than the screw driver 14, it can be employed in substantially any space that can accomodate the screw driver; it is not limited by the expanison of the claws as in prior devices. Moreover, the assembly can also be readily removed from the screw driver shank to allow the screw driver to be used in its original form.

The screw driver 14 can be easily rotated manually (or through an auxiliary power source) to drive the threaded screw into the member M with slippage between the driver head and the screw being substantially prevented. Since the assembly 12 maintains the relative alignment relationship, the operator is free to use two hands to effect drive if required, and he may remove the screw driver 14 from the screw and be assured that it will readily return into driving engagement. As the screw is being driven into the member M, the assembly 12 slides on the shank 14*a* until the screw if fully seated. After the screw is fully driven into the member M, the assembly 12 may be readily removed from the screw driver 14, or may be slid up on the shank 14*a* to be stored on the shank out of the way until again needed.

The invention has been described in detail with reference to preferred embodiments thereof, but it will be understood that variations and modifications can be effected within the spirit and scope of the invention.

We claim:

1. A device for facilitating driving of a threaded screw into a member by a screw driver having a shank and drive head, said device comprising:

an elongated cylindrical housing having first and second longitudinally aligned portions, said first portion a cavity having defined by on internal surface adapted to readily removably receive said shank of said screw driver, a portion of said internal surface having means to provide a friction fit with said shank for restraining said shank to limit relative movement of said first portion with respect to said shank along the longitudinal axis of said shank, the remaining portion of said internal surface being larger in cross-section than the cross-section of said portion of said internal surface, and further defining an enlarged U-shaped longitudinal slot in communication with said cavity through which the drive head and shank of said screw driver are insertable, at an angle to the longituduinal axis of said first portion into said cavity, and fulcrum means formed by said cavity for enabling said shank to be pivoted into engagement with said longitudinal axis of said first portion; and said second portion defining a cavity substantially circular in cross-section adapted to have one end engageable with the member into which the screw is to be driven and receive a threaded screw and drive head, with said drive head in driving relation with such screw.

2. The invention of claim 1 wherein at least said first portion of said housing has a cross-sectional configuration complimentary to and slightly smaller than the cross-section of said screw driver shank so as to effect the friction fit.

3. For use with a screw driver of standard configuration having a shank and a drive head, a device for facilitating driving of a threaded screw into a member by holding such screw driver in driving engagement with such threaded screw, said device comprising:

first means for removably engaging said shank of said screw driver, said first means including a substantially cylindrical housing readily receiving said shank of said screw driver, said housing having an internal surface, portion of said internal surface having means for restraining said shank to limit relative movement of said first means with respect to said shank along the longitudinal axis of shank, a longitudinal U-shaped slot in said first means in communication with said internal surface enabling said drive head and said shank of said screw driver to be insertable, at an angle with respect to the longitudinal axis of said first means into said first means, and fulcrum means formed by said internal surface for enabling said shank to be pivoted into alignment with said longitudinal axis of said first means; and second means, connected to said first means, said second means including a subsantially cylindrical housing for engagement with the member into which the screw is to be driven, and said second means having a cavity surrounding a threaded screw and drive head with said drive head in driving relation with such screw.

* * * * *